United States Patent [19]

Friberg

[11] Patent Number: 4,762,250

[45] Date of Patent: Aug. 9, 1988

[54] VENDING MACHINE

[76] Inventor: Bo S. Friberg, Stensta-Skepptuna, S-195 00 Mästa, Sweden

[21] Appl. No.: 796,765

[22] Filed: Nov. 12, 1985

[30] Foreign Application Priority Data

Nov. 19, 1984 [SE] Sweden ..... 8405804

[51] Int. Cl.[4] ..... B65D 83/00

[52] U.S. Cl. ..... 221/123; 221/133; 221/150 A; 221/191; 221/224; 221/258

[58] Field of Search ..... 221/123, 124, 126, 129, 221/130, 131, 133, 150 R, 150 A, 191, 224, 258; 219/10.55 R, 214; 99/443 C; 414/589, 609, 610, 628, 630, 638, 639

[56] References Cited

U.S. PATENT DOCUMENTS

| | | | |
|---|---|---|---|
| 3,397,817 | 8/1968 | Smith | 221/150 |
| 3,539,751 | 11/1970 | Levinson | 219/10.55 |
| 4,108,333 | 8/1978 | Falk et al. | 221/13 |
| 4,482,078 | 11/1984 | Reiss | 221/150 A |
| 4,490,923 | 1/1985 | Thomas | 219/10.55 R |
| 4,513,879 | 4/1985 | Reis | 221/150 A X |

FOREIGN PATENT DOCUMENTS

| | | | |
|---|---|---|---|
| 956604 | 10/1974 | Canada | 221/150 A |
| 52-43499 | 4/1977 | Japan | 221/129 |
| 52-53500 | 4/1977 | Japan | 221/150 A |
| 379109 | 9/1975 | Sweden . | |
| 1482031 | 8/1977 | United Kingdom . | |

*Primary Examiner*—H. Grant Skaggs
*Assistant Examiner*—David H. Bollinger
*Attorney, Agent, or Firm*—Stevens, Davis, Miller & Mosher

[57] ABSTRACT

A vending machine for combined dispensing of articles which are restricted in shape and size only by the narrowest passage within the machine, and for heating and dispensing of ready-to-eat food portions. The vending machine includes a cabinet and a store-closet provided with a number of shelves arranged one above the other for storage of the articles. The shelves end at a distance behind the front of the store-closet to form a lift shaft wherein a carriage is vertically and laterally displaceable for transferring the articles from their respective storage spaces within the storage-closet to a microwave oven which is positioned outside the store-closet but within the cabinet. The bottom of the microwave oven has the shape of a truncated cone, and the oven-lid likewise has the shape of a truncated cone with the same cone angle as the oven bottom whereby scattering of microwave energy in the surroundings is prevented.

2 Claims, 3 Drawing Sheets

VENDING MACHINE

BACKGROUND OF THE INVENTION

The present invention relates to a vending machine for combined dispensing of articles which are intended to be heated or not to be heated and which are restricted in shape and size only by the narrowest passage within the machine, and for dispensing of ready-to-eat food portions which optionally can be heated.

The demands from customers to purchase articles and get meals served at those times which suit them best, are large today. One part in the efforts to meet these demands is the possibility to make shopping from vending machines. Recently, the sale from vending machines also has increased markedly. However, vending machines known in the art are afflicted with the disadvantage that the assortment is restricted to articles which in shape and size must be strictly adapted to the dispensing system of the machine, which includes usually wire screws. Moreover, the articles must be of a nature to withstand the rather harsh treatment by the dispensing mechanism when they are pushed over the shelf edge from which they drop into a delivery compartment.

In Swedish Patent No. 7400229-6 a vending machine is described the usefulness of which is strictly limited to articles of uniform shape and size.

In applicant's Swedish Patent Application No. 8402268-0 a vending machine is described wherein the articles are pushed over a shelf edge by means of pusher chain conveyors and collected in a delivery compartment.

SUMMARY OF THE INVENTION

The continued development work which resulted in the present invention was made along a partially new concept with the aim to provide a serviceable vending machine wherein the articles are cautiously handled and oriented in predetermined positions in the course of the transport through the machine. Another object is to provide a vending machine with the capability in the transportation line to include a device for heating of the articles, preferably a microwave oven.

The above objects have been carried out in a vending machine which has been given the features of the accompanying claims.

DESCRIPTION OF THE DRAWINGS

The invention will be described with reference to the accompanying figures.

DESCRIPTION OF THE PREFERRED EMBODIMENT

Figure 1:
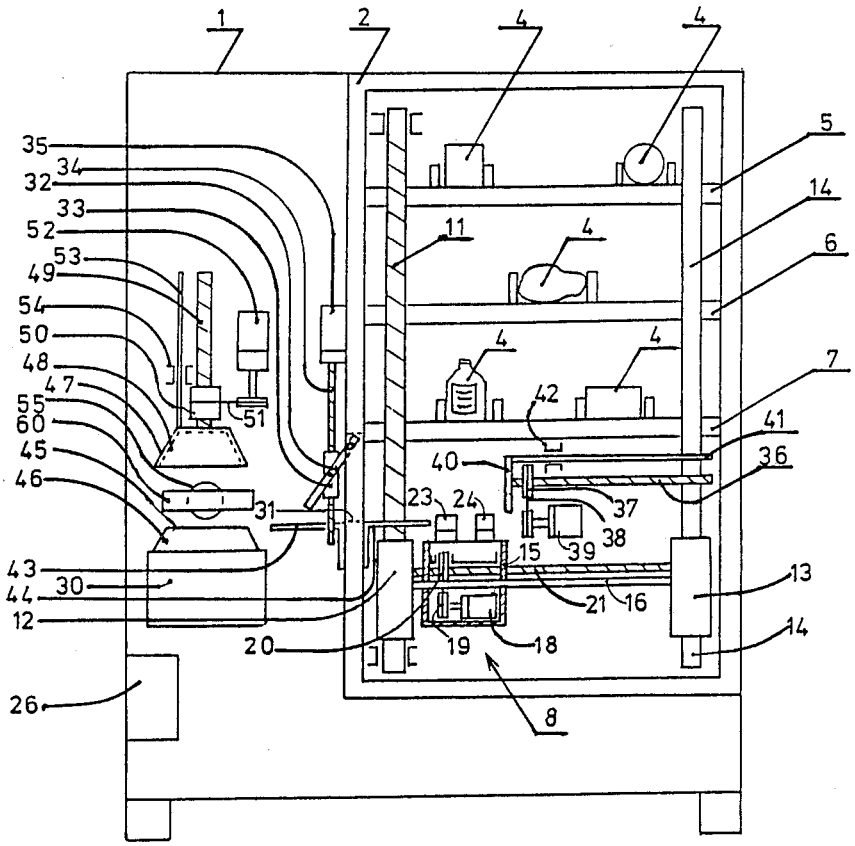
FIG. 1 is a front view of a vending machine according to one embodiment.
Figure 2:
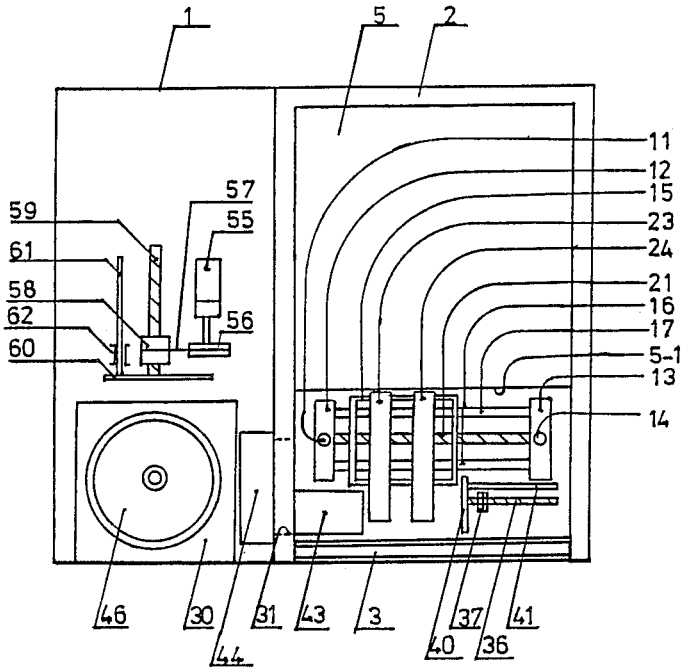
FIG. 2 shows the vending machine as seen from above.

The vending machine shown in FIG. 1 includes a preferably rectangular cabinet 1 which is shown only schematically. Within the cabinet 1 a store-closet 2 is mounted. Preferably, the store-closet 2 has heat insulated walls and can be built either as a freezer, a refrigerator, a heating closet, or may be entirely untempered. The front of the cabinet 1 may advantageously be built as a lockable swing-door (not shown). In FIG. 2 a glazed door 3 is shown through which the merchandise assortment 4 is exposed. A number of shelves 5, 6, 7 extend in several planes over the width of the store-closet 2 from the back wall towards the front, terminating with their front edges 5-1, 6-1, 7-1 at a distance therefrom to form a lift shaft. In the store-closet 2 a collecting device 8 is provided for selection of articles 4.

Figure 3:
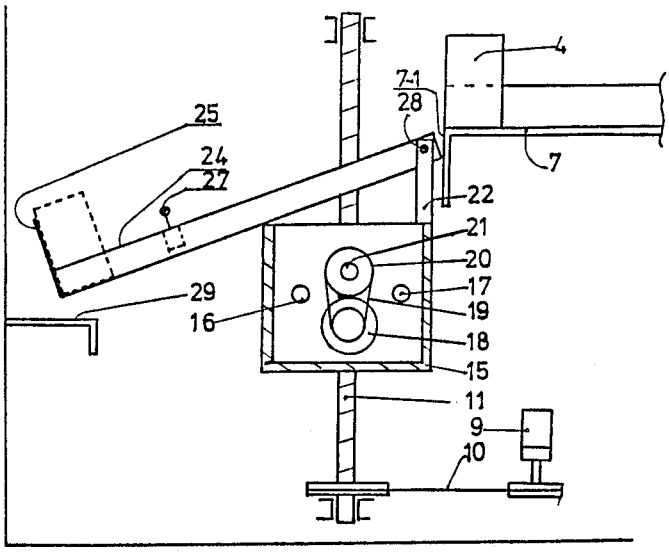
FIG. 3 is a detail side view on an enlarged scale of the vending machine, showing a vertically movable collecting device in an elevated position to transfer an article from a storage shelf to a delivery compartment.

The collecting device 8 includes a first reversible electrical motor 9 (FIG. 3) which, via an endless chain 10, is rotatably connected to a screw spindle 11 which is vertically journalled in the lift shaft. A nut 12 is screwed onto the vertical screw spindle 11, and onto said nut 12, and onto a guide 13, which is slidably journalled for vertical displacement in the shaft on a guide bar 14 mounted in parallel relationship to the screw spindle 11, a carriage 15 is slidably mounted on two parallel, horizontal shafts 16, 17 for lateral displacement with respect to the front wall of the cabinet 1. The nut 12 is fastened to the horizontal shafts 16, 17 so that the carriage will be lifted or lowered on the screw spindle 11 upon its rotation in one direction or the other. Furthermore, for lateral displacement of the carriage 15, a second reversible electrical motor 18 (FIG. 1) is provided via an endless chain 19 (FIG. 3) to rotate an internally threaded sprocket wheel 20 which is rotatably mounted on the carriage 15. By turning the sprocket wheel 20 on a stationary screw spindle 21, the carriage 15 can be moved to a desired lateral position between the nut 12 and the guide 13.

A post 22 mounted at the carriage 15 carries a number of chutes 23, 24, at the free ends of which a stop member 25 is mounted.

For activating the collecting device 8, the customer can make payment in a usual manner in a device not shown with payment means in form of coins, bills and/or tokens or tickets. The vending machine can also be provided with sensors for reading of magnet cards.

The customer orders an article by pushing or touching one or more buttons in a key-board of a contactor set (not shown). The signals initiated by the contactors are fed to an electronic control unit 26. With an impulse from the control unit 26 the first motor 9 is started and rotates the screw 11 so that, by engagement of the nut 12 with the screw 11, the carriage 15 is lifted to the shelf plane where the selected article is placed. After the first motor 9 has stopped, the second motor 18 for lateral displacement is started to move the carriage 15 sideways until it is stopped in a position right in the front of the selected article. Thereafter, a dispensing device, which is the object of my Swedish Patent Application No. 8402268-0, is started. The selected article is pushed over the shelf edge so that it slides down the chutes 23, 24 to the stop member 25. On its way down the chute the article operates a switch 27 for the control unit 26 so that continued propulsion is stopped and the reversible motors 9 and 18 are started again for rotation in the reverse direction. The carriage 15 with the article supported by the stop member 25 is moved back to the starting-point close to the nut 11. At the same time, by turning the screw spindle 11 in the opposite direction, the carriage 15 is lowered to its starting-point at the bottom of the closet as shown in FIG. 4.

The carriage 15 can be directed to various positions either by means of a switch attached to the carriage (not shown), which senses protruding cams at different shelf planes and merchandise lines, or by means of electronic position sensors, which can be of the linear or rotary type. In both cases electrical signals are generated and processed in a microcomputer of the control unit 26 so that the carriage 15 can be directed to desired positions both horizontally and vertically.

The chutes 23, 24 are connected to the post 22 via a joint 28 by means of which the chutes are supported on the opposite edge of the carriage 15 (FIG. 3) in an inclination which is governed by the width of the carriage 15 and the heigth of the joint above the carriage edge. An inclination of about 20° as shown ensures that the article will slide down the chute by its own weight and come to rest against the stop member 25. On account of the fact that the chutes 23, 24 are pivotally, via the joint 28, connected to the post 22 which stands up from the carriage 15, just before the carriage on its travel downwards reaches the lowest point, the chutes 23, 24 will be caught by a shelf 29 protruding into the space between the inner wall of the cabinet 1 and the screw spindle 11. The shelf 29 is located on such a height above the closet-bottom, that the chutes 23, 24 will take a horizontal position when the carriage 15 reaches its bottom-point.

Figure 4:
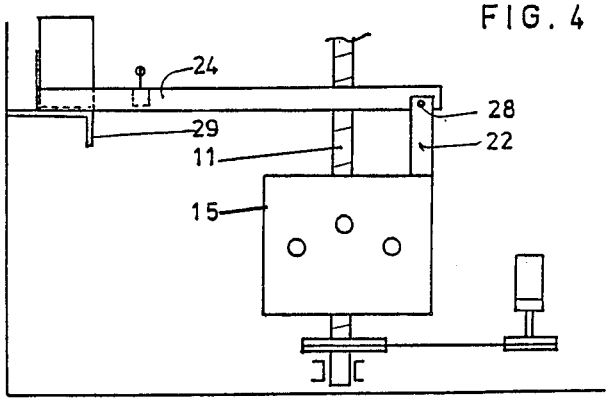
FIG. 4 is a detail view similar to FIG. 1, showing the collecting device in a bottom position for forwarding the article through the vending machine.

After termination of the described collecting operation, the carriage 15 takes the position shown in FIG. 4, with the chutes 23, 24 horizontal and the ends resting on the shelf 29 with the article lying close to the stop member 25.

In order to transfer the collected article to a microwave oven 30, which is situated within the cabinet 1 but outside the closet 2, the wall of the closet 2 facing the microwave oven presents a rectangular outlet opening 31 which is normally kept closed by means of a swing-flap 32 suspended at the upper edge of the opening. The swing-flap 32 can be opened by means of a closing mechanism including a nut 33 fastened to the flap 32, a screw spindle 34 cooperating with the nut 33, and a third reversible electrical motor 35 mounted at the oven wall for rotation of the screw spindle 34.

For feeding the article from the closet 2 to the microwave oven 30, a laterally displaceable screw spindle 36 is mounted on a level with the planes of the chutes 23, 24 in the bottom position of the carriage 15. The screw spindle 36 engages the internal threads of a sprocket wheel 37 which is stationary journalled in the cabinet 1. The sprocket wheel 37 in turn is rotatably attached via an endless chain 38 to a fourth reversible electrical motor 39 mounted in the closet 2. The screw spindle 36 is securely attached with its free end in a dog plate 40. In order to prevent joint rotation with the screw spindle 36, the dog plate 40 is securely connected to a push rod 41 extending in parallel relationship to the screw spindle 36 and slidably received in a guide 42 which is attached to the wall of the closet 2.

When after loading with the article slipped down the chutes 23, 24, the carriage has been moved back to the starting point shown in FIG. 4 at the bottom of the closet 2, a switch (not shown) activates, via the control unit 26, the third reversible motor 35 by the rotation of which the swing-flap 32 is opened by the screw spindle 34. Immediately thereafter, the fourth reversible electrial motor 39 for transmission of the article to the microwave oven is started through the control unit 26. The dog plate 40 is moved forward by the rotating screw spindle 36 so that the article resting on the chutes 23, 24 is pushed over a couple of shelves 43, 44 into the microwave oven 30 at rest on its bottom plane 45.

According to the present invention, the bottom 46 of the microwave oven 30 has the shape of a truncated cone, and the oven lid 47 likewise has the shape of a truncated cone having the same cone angle as the oven bottom 46. Thereby, escape of microwave radiation from the cavity 48 created between the bottom 46 and the lid 47 of the oven in closed position is prevented.

For operation, the oven lid 47 is secured to the lower end of a vertical screw spindle 49 which, via an internally threaded sprocket wheel 50 and an endless chain 51, is rotatably connected to a fifth reversible electrical motor 52. In order to prevent rotation of the oven lid 47 during the closing and lifting operations, a guide bar 53 is attached to the oven lid 47 in parallel relationship to the screw spindle 49 and passed through a guide 54 which is securely mounted at the inner wall of the vending machine.

When the article taken out has been pushed over to the bottom plane 45 of the microwave oven 30 by the dog plate 40, the position of the article in the oven is sensed by a switch or photocell (not shown). A signal is transmitted to the control unit to return the dog plate 40, shut the swing-lid 32 and start the fifth reversible electrical motor 52, which, via the endless chain 51, rotates the internally threaded sprocket wheel 50 so that the lid 47 attached to the screw spindle 49 is lowered over the bottom 46 of the microwave oven 30.

When the oven lid 47 has reached its lowermost position tightening against the bottom 46, a switch (not shown) is actuated to turn on the current to the microwave oven 30. The heating time can vary from article to article and is governed by the programming of the control unit 26.

After expiration of the programmed heating time, the control unit 26 shuts off the oven current and energizes the fifth reversible electrical motor 55 which, via the endless chain 51, rotates the sprocket wheel 50 to lift the oven lid 47 to its upper position by the rotating screw spindle 49. Then, by actuation of a switch (not shown), a sixth reversible electrical motor 55 is started via the control unit 26 to rotate an internally threaded sprocket wheel 58 via a sprocket wheel 56 and an endless chain 54 to turn a screw spindle 59 outwards. A dog plate 60 attached to the screw spindle 59 pushes the now heated article out of the microwave oven 30 and further to a dispensing compartment (not shown), where the article can be fetched by the customer. A guide bar 61 which is fastened to the dog plate 60 and slidably displaceable in a stationary guide 62, prevents the screw spindle 59 from rotation with the sprocket wheel 58. The procedure described is applicable to an article to be heated. If the customer selects an unheated article, the described procedure is applicable except for the fact that when the ordered article has been pushed inwards onto the bottom plate 45 of the microwave oven 30, the dispensing motor 55 is started directly without previous heating of the article.

The present invention provides a vending machine exhibitiing, among other things, the following advantages:

(1) The vending machine is equipped with an insulated goods container wherein the temperature can be maintained within wide limits such as, for instance, between −25° C. and +50° C., according to the demands made upon the assortment.

(2) The size and shape of the articles need not be fixed but is limited only with regard to the narrowest passage appearing in the course of the transportation of the article from the store shelf to the delivery compartment.

(3) The bottom and lid of the microwave oven are both in the shape of a truncated cone the base diameter and cone angle of which are equal both for the bottom and lid. Thereby, an effective tightening against scattering of microwave energy in the surroundings is prevented.

(4) The number of items with different prices can be as large as the number of available ware compartments.

(5) With the handling and transportation system provided by the present invention it is possible to convey various kinds of wares at different sites in the same vending machine from their respective display sites to one and the same position in a microwave oven to be heated, or to be transferred directly to the delivery compartment.

I claim:

1. A vending machine for combined dispensing of variable sized articles which are restricted in shape and size only by the narrowest passage within the machine, and for heating and dispensing of ready-prepared food portions, including (a) a cabinet; (b) a storage-closet arranged in the cabinet comprising a back wall, a front and an outlet opening and equipped with a number of shelves for storage of the articles; (c) means within the storage-closet for transportation of a selected article from its position within the storage-closet into a microwave oven including a removable lid situated within the space of the cabinet outside the storage-closet; and (d) means for operating the microwave oven and for transferring the articles from the oven and farther to a delivery compartment, characterized by the combination of features comprising:

(i) said shelves (5,6,7) extending from the back wall of the storage-closet towards the front, terminating with their front edges at a distance therefrom to form a lift shaft;

(ii) said means for transportation of an article into the microwave oven positioned within said storage-closet and comprising:

(a) a carriage which is vertically adjustable and laterally displaceable along the front edges of the shelves;

(b) means on the carriage for receiving the article delivered from the shelves and transferring the article to an outlet opening at the bottom of the storage-closet; and (c) means for moving the article received at the outlet opening into the microwave oven;

and wherein said means for receiving the article delivered from the shelves comprises at least one chute which is pivotally journalled on the carriage at right angles to the front edges of the shelves, said chute being provided on its free end with a stop member and is supported in an inclination which ensures that the article will slip down the chute by its own weight at rest against the stop member, and a dog plate being arranged on a level with the chutes in a horizontal position and carriage in a lowest position for transferring the article through an outlet opening into a bottom of the microwave oven.

2. The vending machine according to claim 1, wherein the bottom of the microwave oven has the shape of a truncated cone, and that the oven-lid likewise has the shape of a truncated cone with the same cone angle as the oven-bottom, whereby scattering of microwave radiation in the surroundings is prevented.

* * * * *